United States Patent [19]

Yunoki

[11] Patent Number: 4,856,695

[45] Date of Patent: Aug. 15, 1989

[54] METHOD OF AND APPARATUS FOR FEEDING SLIDE FASTENER CHAIN WITH FLY STRIPS

[75] Inventor: Akio Yunoki, Namerikawa, Japan

[73] Assignee: Yoshida Kogyo K. K., Tokyo, Japan

[21] Appl. No.: 184,594

[22] Filed: Apr. 21, 1988

[30] Foreign Application Priority Data

Apr. 22, 1987 [JP] Japan ..... 62-100412

[51] Int. Cl.[4] ..... B65H 20/02; B65H 20/04

[52] U.S. Cl. ..... 226/154; 226/181

[58] Field of Search ..... 226/154, 155, 181; 29/33.2, 408, 767, 768, 409, 410, 770

[56] References Cited

U.S. PATENT DOCUMENTS

| | | | |
|---|---|---|---|
| 3,371,770 | 3/1968 | Graham et al. | 226/155 X |
| 4,520,544 | 7/1985 | Morita et al. | 29/408 |
| 4,545,118 | 10/1985 | Fisher et al. | 29/408 X |
| 4,606,100 | 8/1986 | Yunoki et al. | 29/33.2 |

FOREIGN PATENT DOCUMENTS 60-85704 5/1985 Japan .

*Primary Examiner*—Daniel P. Stodola
*Assistant Examiner*—Phillip Han
*Attorney, Agent, or Firm*—Hill, Van Santen, Steadman & Simpson

[57] ABSTRACT

A method of feeding a continuous slide fastener chain with successive fly strips in a slide-fastener finishing machine, comprises feeding the slide fastener chain with successive fly strips along a horizontal straight path normally by applying driving force to one tape free of the fly strips, and feeding the slide fastener chain by applying the driving force to both of the opposed tapes while the slide fastener chain is threaded through a slider. An apparatus for carrying out this method comprises a main roller engageable with the lower surfaces of the opposed tapes, and first and second associate rollers engageable with the respective upper surfaces of the opposed tapes and vertically movable independently of each other.

5 Claims, 5 Drawing Sheets

METHOD OF AND APPARATUS FOR FEEDING SLIDE FASTENER CHAIN WITH FLY STRIPS

BACKGROUND OF THE INVENTION

1. Field of the Invention

The present invention relates to production of slide fasteners for trousers, and more particularly to a method of and apparatus for feeding a continuous slide fastener chain with successive fly strips while various finishing steps, such as threading sliders and attaching bottom steps, is successively taking place on the slide fastener chain to provide slide fasteners of a predetermined length each having a fly strip.

2. Description of the Prior Art

In the manufacture of trousers, it has been customary to use, a continuous slide fastener chain to which successive fly strips are attached at equal distances by sewing the individual fly strips onto a tape of one of opposed stringers. Each fly strip is a prospective closure for a front fly opening of the trousers. At the start of a series of finishing steps, each fly strip is folded on such one stringer tape so that the resulting slide fastener chain has a difference in thickness between the opposed stringers. Because of this thickness difference, the slide fastener chain cannot be fed along a straight path as it passes a pair of vertically opposed feed rollers. Yet, if the slide fastener chain is fed in and along an elongated guide, twisting stresses would act on the slide fastener chain so as to cause the folded flies to become disarranged.

A solution has been proposed in Japanese Patent Laid-Open Publication No. 60-85704, in which a pair of vertically opposed feed rollers, one of which is driven, has upper and lower toothed wheels, respectively, for meshing engagement with a pair of coupled rows of fastener elements of the opposed stringers during the feeding of the slide fastener chain. The upper roller is adapted to be raised away from the lower roller to allow an individual slider on the slide fastener chain to pass the two feed rollers. However, a primary problem with this prior art apparatus is that the toothed wheels would be often brought out of meshing engagement of the fastener elements, thus causing an irregular feeding of the slide fastener chain.

SUMMARY OF THE INVENTION

It is therefore an object of the present invention to provide a method of and apparatus for feeding a continuous slide fastener chain with successive fly strips accurately along a straight path without imparting any twisting stress to the slide fastener chain.

According to a method of the present invention, a continuous slide fastener chain with successive fly strips is fed normally by applying driving force to one tape free of the fly strips, and the slide fastener chain is fed by applying the driving force to both the two tapes during the threading of a slider.

For carrying out the above method, an apparatus comprises a main roller engageable with lower surfaces of opposed tapes of a continuous slide fastener chain, and first and second associate rollers engageable with respective upper surfaces of the opposed tapes and vertically movable independently of each other.

With this arrangement since the slide fastener chain with the successive fly strips is fed by applying driving force to one tape free of the flies, it is possible to feed the slide fastener chain accurately in order along a straight path without imparting any twisting stress to the slide fastener chain and hence without causing the folded fly strips to become disarranged. Further, sine the slide fastener chain is fed by applying driving force to both the two tapes during the slider threading step, it is possible to feed the slide fastener chain with adequate strength so as to be threaded through a slider smoothly and correctly.

Many other advantages, features and additional objects of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION

Figure 1:
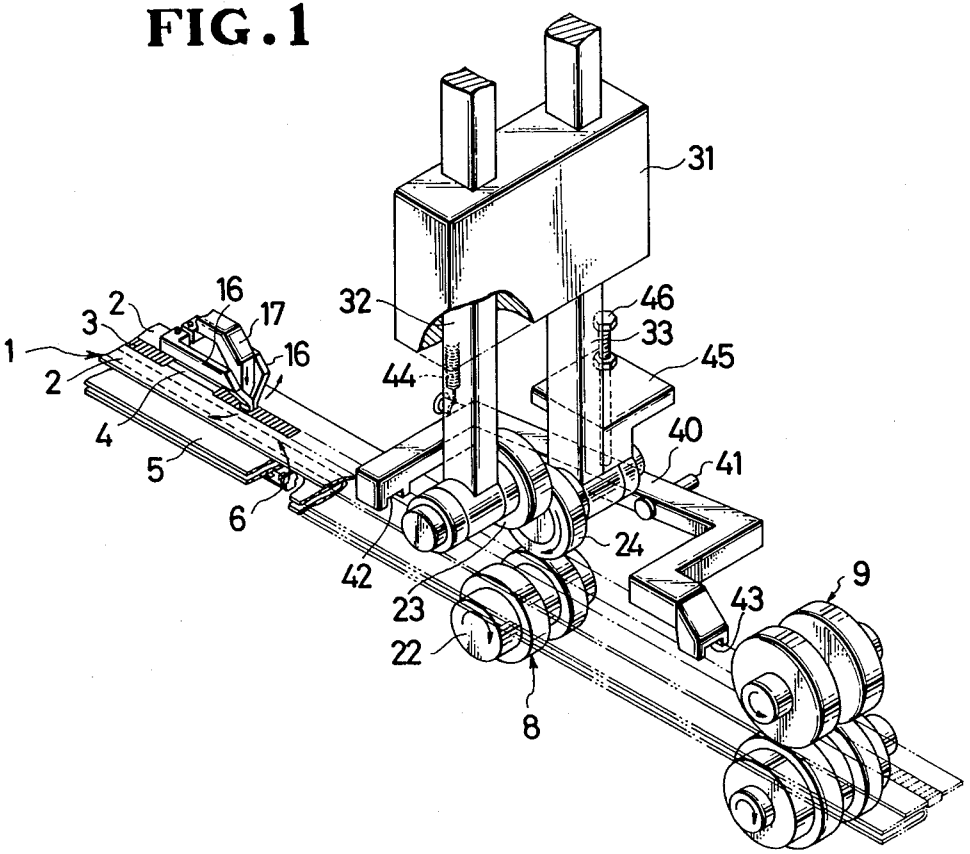
FIG. 1 is a perspective view, with parts broken away, of a fastener-chain feed apparatus embodying the present invention.
Figure 6:
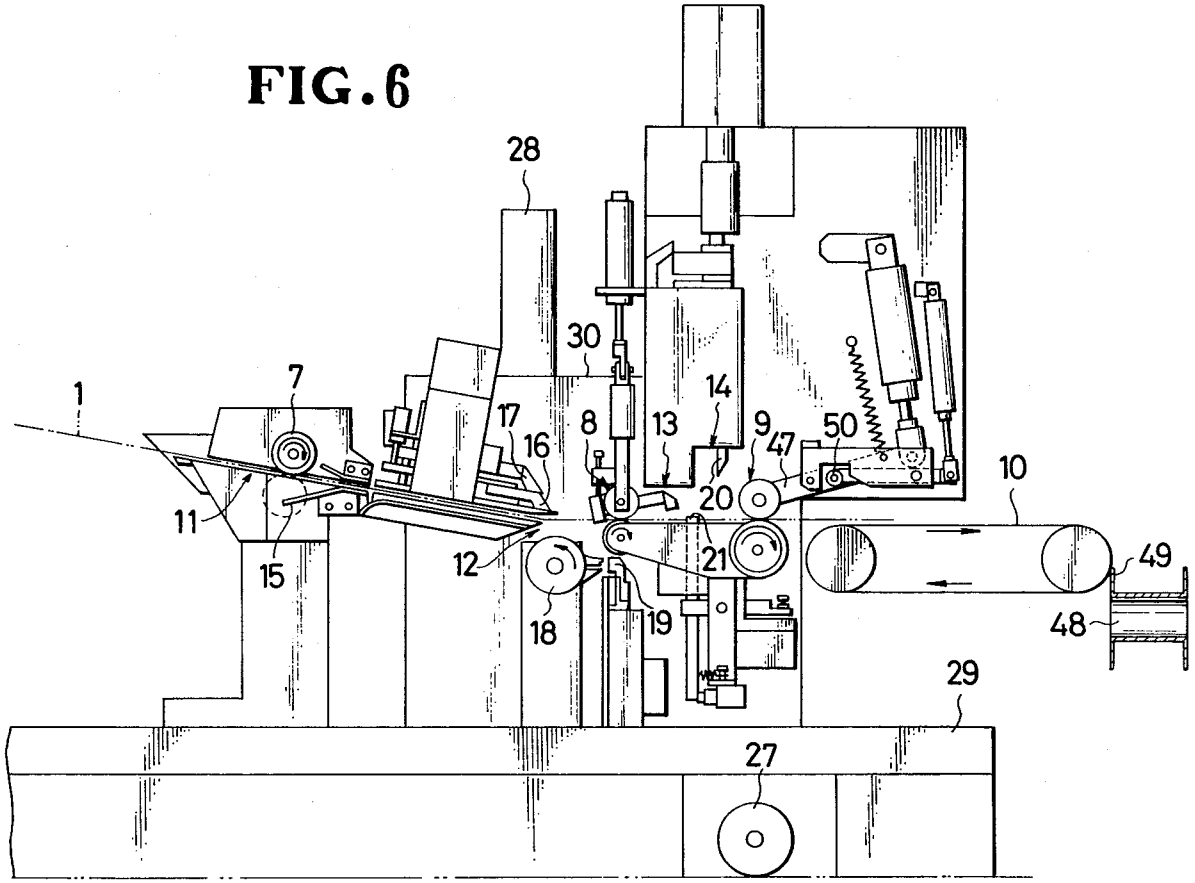
FIG. 6 is a side elevational view of a slide-fastener finishing machine in which the feed apparatus of the invention is incorporated.

FIG. 6 shows a slide-fastener finishing machine for producing from a continuous slide fastener chain 1 with successive fly strips 5 slide fasteners of a predetermined length for trousers. The principle of the present invention is particularly useful when embodied in a fastener-chain feed apparatus such as shown in FIGS. 1 and 6, generally indicated by the numeral 8.

The slide fastener chain 1 comprises a pair of substantially endless or continuous-length stringers including a pair of tapes 2, 2 and a pair of coupled rows of fastener elements 3, 3 mounted on and along the respective inner longitudinal edges of the tapes 2, 2 there being a plurality of element-free spaces 4 spaced at equal distances longitudinally along the slide fastener chain 1. The fly strips 5 are attached to a lower surface of one tape 2 by sewing, each fly strip 5 being a prospective closure for a front fly opening of the trousers. Each fly strip 5 has a width larger than the width of the slide fastener chain 1 initially, i.e. when it is sewn to the tape 2. At the start of a series of finishing steps, each fly strip 5 is folded on such one tape 2 as shown in FIG. 1.

While the slide fastener chain 1 with the fly strips 5 is being fed along a horizontal straight path through the machine of FIG. 6, a series of finishing steps take place one after another. These finishing procedures start with the step of folding the successive fly strips 5, which is followed by the step of threading a slider (not shown) onto the pair of coupled rows of fastener elements 3, 3, whereupon the slide fastener chain 1 is severed transversely across a leading one of the element-free space 4. The feeding of the slide fastener chain 1 through the finishing machine is performed by a pair of guide rollers 7, the feed apparatus 8 embodying the present invention, a pair of discharge rollers 9, and a conveyor 10, as shown in FIG. 6.

The finishing machine comprises a fly-strip folding unit 11, a slider threading unit 12, a bottom-stop attaching unit 13 and a cutting unit 14, which are disposed in this order (from left to right in FIG. 6) along the path of the slide fastener chain 1.

The fly-strip folding unit 11 includes the guide rollers 7 for compressing the slide fastener chain 1 with the fly strips 5 and an inclined guide plate 15 for pre-folding the fly strip 5 as shown in FIG. 1.

The slider threading unit 12 as shown in FIGS. 1 and 6, includes a pair of claws 16, 16 normally engageable with the fastener element rows 3 and projectable into a leading element-free space 4 when the latter arrives at the slider threading unit 12, a wedge-shaped member 17 disposed between the two claws 16, 16 for moving apart the same to widen the element-free space 4 to thereby disengage the leading end portion of the fastener element rows 3 to a slight extent.

The slider threading unit 12 also includes a slider holder 18 normally disposed below the path of the slide fastener chain 1 for receiving a slider 6 from a chute 19 and pivotally movable to insert the slider 6 into the widened element-free space 4. With the slider 6 kept in the widened element-free space 4, when both of the claws 16, 16 are removed from the element-free space 4, the opposed inner element-free edges of the tapes 2, 2 are moved toward each other to enter a Y-shaped guide channel of the slider 6 under the tension of the slide fastener chain 1.

The bottom-stop attaching unit 13 includes a punch and a die, both not shown; while the punch is being lowered, an elongated strip of metal is inserted between the punch and die transversely of the path of slide fastener chain 1 and is then severed to provide a bottom-stop blank. This bottom-stop blank is finally clinched astride of the opposed inner tape edges.

The cutting unit 14 includes a cutter 20. When a stop 21 is inserted into the element-free space 4, a detector (not shown) produces an electrical signal to the cutting unit 14, whereupon the cutter 20 is moved downwardly.

Figure 3:
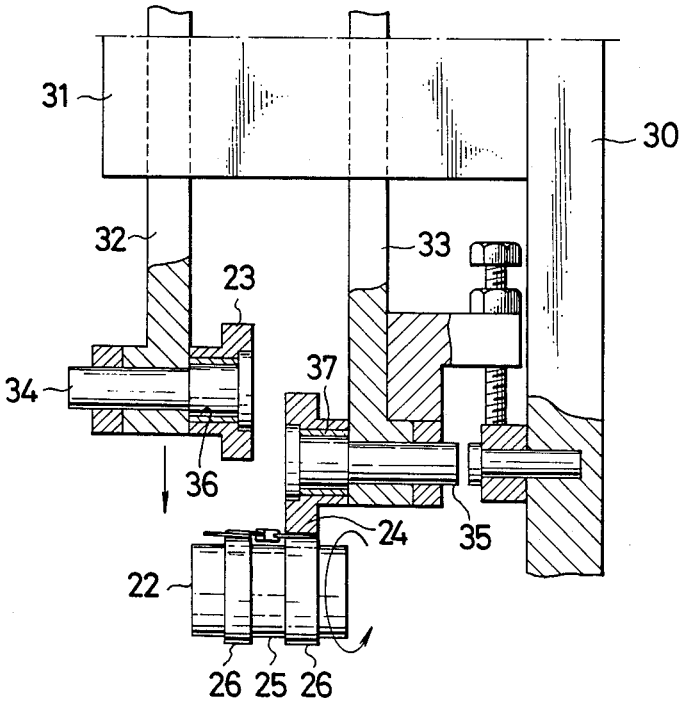
FIG. 3 is a fragmentary, enlarged detail view, partly in cross section, of FIG. 2.

Most important, the feed apparatus 8 of the present invention is located between the slider threading unit 12 and the bottom-stop attaching unit 13 and comprises, as shown in FIGS. 1 and 3, a main roller 22 disposed below the path of the slide fastener chain 1 and engageable with the lower surface of the opposed tapes 2, 2 in a manner described below.

The main roller 22 is connected selectively to two driving systems via a clutch (not shown); that is, the main roller 22 is driven by a motor 27 (FIG. 6) during the normal feeding of the slide fastener chain 1, and is driven by a first cylinder 28 (FIG. 6) via a rack and a pinion, both not shown, during the slider threading step.

Figure 2:
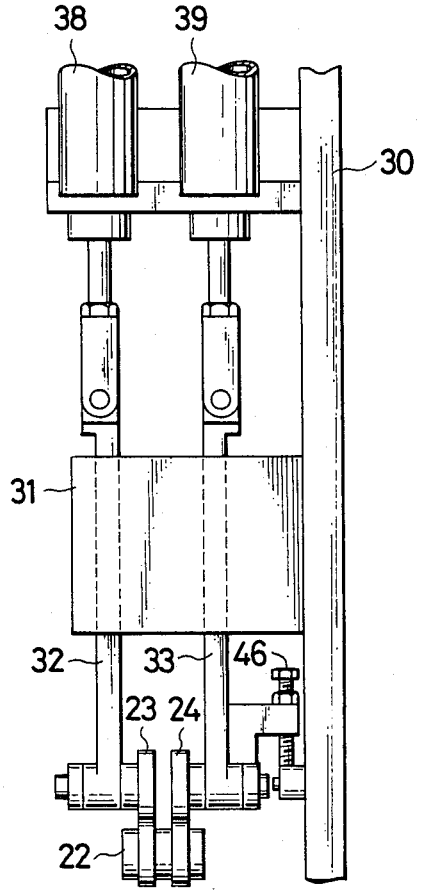
FIG. 2 is a front elevational view, on a reduced scale, of FIG. 1.

As shown in FIGS. 2, 3 and 6, a support plate 30 is fixed to a base 29 and supports a guide block 31 above the path of the slide fastener chain 1. The main roller 22 has a pair of axially spaced large-diameter roller sections 26, 26 engageable with the respective lower surfaces of the opposed tapes 2, 2, the two large-diameter roller sections 26, 26 defining therebetween an annular guide groove 25 receptive of the opposed rows of fastener elements 3, 3 as the slide fastener chain 1 passes over the main roller 22. The feed apparatus 8 also includes a pair of normally axially spaced first and second associate rollers 23, 24 disposed above the path of the slide fastener chain 1 and engageable with the respective upper surface of the opposed tapes 2, 2. A pair of vertical rods 32, 33 vertically movably extends through the guide block 31 and support on its respective lower ends a pair of non-rotatable shafts 34, 35 on which the first and second associate rollers 23, 24 are mounted via a pair of metal bushes 36, 37, respectively. These vertical rods 32, 33 are operatively connected at their respective upper ends to first and second cylinders 38, 39. Thus the first and second associate rollers 23, 24 are vertically movable independently of each other.

As shown in FIG. 1, the feed apparatus 8 is associated with an element guide which includes a lever 40 pivotally mounted on the support plate 30 by a horizontal pin 41. The lever 40 has at its upstream and downstream ends a pair of downwardly facing first and second guide grooves 42, 43, respectively. An extension spring 44 is mounted between the support plate 30 and the lever 40 to urge the same 40 to normally pivot clockwise in FIG. 1. Thus the second guide groove 43 of the downstream end of the lever 40 is normally urged against the slide fastener chain 1 being fed.

As shown in FIGS. 1, 2 and 3, the vertical rod 33 for the second associate roller 24 has a horizontal projection 45 on which a pusher member 46, in the form of a threaded bolt, is vertically adjustably mounted. The pusher member 46 serves to depress the upstream end of the lever 40 downwardly. With this arrangement, the second guide groove 43 of the downward end of the lever 40 is lowered when the second associate roller 24 is raised, and on the contrary, the first guide groove 42 of the upstream end of the lever 40 is lowered when the second associate roller 24 is lowered.

As shown in FIG. 6, the lower one of the discharge rollers 9 is driven by the motor 27, and the upper discharge roller 9 is mounted on a pivotally movable arm 47. The conveyor 10 transmits the finished slide fasteners from the discharge rollers 9 into a container or box 49 carried by another conveyor 48 running transversely of the first-named conveyor 10. Designated by 50 is a pressure roller for pressing the finished slide fasteners on the conveyor 10.

Figure 4:
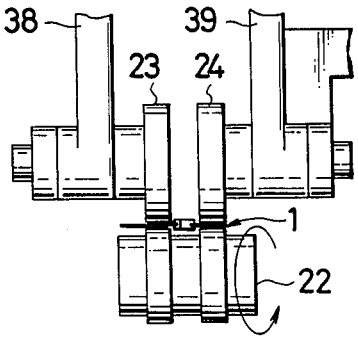
FIG. 4 shows the relative position of feed rollers of the apparatus during the slider threading step.
Figure 5:
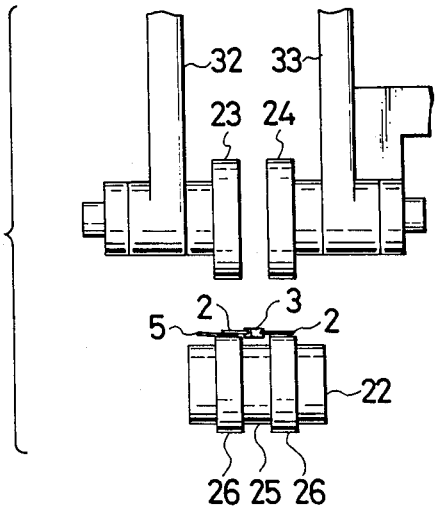
FIG. 5 shows the relative position of the feed rollers when a slider carried on the slide fastener chain passes the feed rollers.

For feeding the slide fastener chain 1 with the successive fly strips 5 by the feed apparatus 8 of the present invention with the upper discharge roller 9 raised, the second associate roller 24 is lowered, and concurrently the first guide groove 42 of the upstream end of the lever 40 is lowered to guide the opposed rows of fastener elements 3, 3 of the slide fastener chain 1, as shown in FIG. 3. When the claws 16, 16 are inserted into the leading element-free space 4, the driving of the main roller 22 is terminated. During the slider threading step, as shown in FIG. 4, the second associate roller 24 together with the first associate roller 23 is lowered and, in the meantime, the main roller 22 is driven by the first cylinder 28. Upon completion of the slider threading, both the first and second associate rollers 23, 24 are raised, and concurrently the second guide groove 43 of the downstream end of the lever 40 is lowered to guide a finished part of the slide fastener chain 1 to the discharge rollers 9 where the finished part of the fastener chain 1 is fed onto the conveyor 10. Thereafter, the second associate roller 24 is lowered to start the subsequent feed of the slide fastener chain 1.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of feeding a continuous slide fastener chain with successive fly strips along a horizontal straight path in a slide-fastener finishing machine including a slider threading station for threading sliders one at a time onto the slide fastener chain, the slide fastener chain having a pair of substantially endless tapes and successive pairs of intermeshed rows of fastener elements mounted on and along inner longitudinal edges of the tapes separated by longitudinally spaced element-free spaces defined therebetween, the successive fly strips being attached to one of the tapes in a posture folded on the one tape, said method comprising the steps of:

(a) feeding the slide fastener chain with the successive fly strips along the straight path by applying driving force only to the other tape free of the fly strips until each respective element-free space arrives at the slider threading station; and (b) feeding the slide fastener chain with the successive fly strips along the straight path by applying the driving force to both of the tapes while the slide fastener chain is being threaded through a slider at the slider threading station.

2. An apparatus for feeding a continuous slide fastener chain with successive fly strips along a horizontally straight path in a slide-fastener finishing machine, said slide-fastener finishing machine including a slider threading station for threading sliders one at a time onto the slider fastener chain, the slide fastener chain including a pair of stringers having a pair of substantially endless tapes and successive pairs of coupled rows of fastener elements mounted on and along opposed inner longitudinal edges of the tapes, separated by longitudinally spaced element-free spaces defined therebetween the successive fly strips being attached to a lower surface of one of the tapes in a posture folded on the one tape, said apparatus comprising:

(a) a single main roller disposed below the straight path and engageable with lower surfaces of both of the tapes; and (b) first and second associate rollers disposed in lateral juxtaposition above the straight path and engageable with respective upper surfaces of the tapes, said first and second associate rollers being disposed above said main roller and vertically movable independently of each other toward and away from said main roller, whereby only one of said associate roller engages the respective tape surface until each respective element-free space arrives at the slider threading station and both of said associate rollers engage the respective tape surfaces at the slider threading station.

3. An apparatus according to claim 2, in which said first and second associate rollers are rotatably supported on respective lower ends of a pair of vertical rods which are operatively connected at their respective upper ends to first and second cylinders for vertical movement.

4. An apparatus according to claim 2; in which said main roller has a pair of axially spaced large-diameter roller sections engageable with the respective lower surfaces of the tapes, the two large-diameter roller sections defining therebetween an annular guide groove receptive of the coupled rows of fastener elements.

5. An apparatus according to claim 2, in which said main roller is adapted to be driven by a motor when said only one of said associate rollers engages the respective tape surface and a cylinder when said associate rollers engage the respective tape surfaces selectively.

* * * * *